United States Patent [19]

Becker et al.

[11] 4,086,850

[45] May 2, 1978

[54] METHOD OF AND APPARATUS FOR COMPACTING SCRAP

[75] Inventors: Hans-Werner Becker, Witten-Bommern; Werner Oberländer, Wetter, both of Germany

[73] Assignee: Maschinenfabrik Becker & Co. Kg, Dortmund-Kley, Germany

[21] Appl. No.: 713,824

[22] Filed: Aug. 12, 1976

[30] Foreign Application Priority Data

Aug. 13, 1975 Germany ..... 2536044

[51] Int. Cl.[2] ..... B30B 9/32

[52] U.S. Cl. ..... 100/42; 100/218; 100/232; 100/233; 100/DIG. 1

[58] Field of Search ..... 100/232, 233, 42, 218, 100/DIG. 2, 244, DIG. 1

[56] References Cited

U.S. PATENT DOCUMENTS

| | | | |
|---|---|---|---|
| 3,170,389 | 2/1965 | Parks | 100/232 |
| 3,283,697 | 11/1966 | Findlay | 100/DIG. 1 |
| 3,610,138 | 10/1971 | Galter | 100/233 |

FOREIGN PATENT DOCUMENTS

| | | | |
|---|---|---|---|
| 846,437 | 8/1960 | United Kingdom | 100/232 |

*Primary Examiner*—Billy J. Wilhite
*Attorney, Agent, or Firm*—Michael J. Striker

[57] ABSTRACT

A scrap compactor has a generally parallelepipedal elongated chamber. The top wall of the chamber may be pivoted down to partially crush the scrap, and a lower portion of one of the side walls of the chamber may be pivoted inward to similarly precompress the scrap. After swinging-in of the lower portion of the one wall this wall is swung outwardly and the opposite wall is moved in while remaining parallel to the other wall. Thereafter the fully compacted scrap may be pushed out an outlet hole in one end of the press.

8 Claims, 5 Drawing Figures

METHOD OF AND APPARATUS FOR COMPACTING SCRAP

BACKGROUND OF THE INVENTION

The present invention relates to a method of and apparatus for compacting scrap. More particularly this invention concerns a scrap-compacting press.

In the commonest scrap-compacting system the scrap is placed in a chamber defined between at least two parallel walls one of which may be moved toward the other while remaining parallel thereto. Frequently it is also possible to move at least one of another two parallel walls perpendicular to the first two walls toward its mate in order to compact or compress the scrap in two mutually perpendicular directions. Such a system is employed normally to reduce the bulk of relatively voluminous scrap in order that it may be fed to a chopper or shear which will reduce it to relatively small pieces that can subsequently be treated. When the scrap is mainly ferrous the small pieces produced by the chopper or shear can be used for steelmaking.

Much of the scrap that must be compacted is of generally regular shape and provided with crosspieces or the like which make it extremely difficult to crush the scrap. Thus, for instance tops and bottoms of boilers and crossmembers in automotive vehicles require a great deal of pressure for crushing such pieces of scrap in a direction parallel to these members. Thus it is necessary to provide extremely heavy rams and crushing members in order to compact such scrap. This overdimensioning greatly increases the cost of the compactor so as to reduce the profitability of reducing scrap for reuse.

SUMMARY OF THE INVENTION

It is therefore an object of the present invention to provide an improved method of and apparatus for compacting scrap.

Another object is the provision of such a system which can be used to compact even relatively voluminous scrap, such as automobiles or boilers, which need not be overdimensioned as described above.

These objects are attained according to the present invention in a scrap-compacting method wherein a piece of scrap is placed in a compaction chamber defined between a first and second spaced-apart walls. At least a portion of the first wall is displaced inwardly into the chamber from a position parallel to the second wall to a position inclined to the second wall to press the piece of scrap against the second wall and partially crush the piece. This nonparallel movement allows the scrap to be at least partially crushed in a direction not perpendicular to its sides, so that any perpendicular crossmembers as described above will be deformed laterally and not simply compressed in a direction parallel to their axes. Thereafter the portion of the first wall is displaced outwardly into a position generally parallel to the second wall and one of the walls is moved inwardly toward the other wall while being maintained parallel to the other wall. Thus, assuming a parallelepipedal piece of scrap, the first wall first crushes it into a generally trapezoidal shape, then the two walls move together in a parallel fashion to crush the trapezoidal piece. At no time must any of the walls of the scrap-compaction chamber move in a direction directly in line with the crossmember, so that the means, usually hydraulic rams, serving to displace these walls need not be dimensioned extremely heavily. The overall cost of such a press is correspondingly reduced.

According to further features of this invention the first and second walls are slidable along a flat base and are both upright on this base. The entire first wall is pivoted about an upright axis on the base which is adjacent its inner face and its one end so that this entire wall can pivot. The other wall is slidable parallel to the first wall in the pulled-back or outer position of this first wall.

In accordance with yet another feature of this invention the compactor is provided with an upper wall which is also pivoted at one end and can be brought from a raised position extending upwardly at an angle relative to the base to a lowered position parallel to the base. This upper wall moves between a pair of upright fixed projections which extend above the first and second wall and which form vertical continuations of these walls.

According to further features of this invention the elongated compaction chamber has a pair of end walls perpendicular to the top and bottom walls and to the side walls. One of these end walls is provided with an outlet opening and the opposite end wall is provided in line with this outlet opening with a pusher. A ram may advance this pusher to displace a compacted piece of scrap out of the chamber through the outlet opening. To this end the outlet opening has a size corresponding substantially to the cross-sectional area which the compacted scrap will assume one the top wall has been dropped down and the side walls have been moved in. The pusher has a plunger which will fit through this outlet opening.

Of course it is possible to operate the compactor in accordance with this invention in the normal fashion, that is without pivoting of the first wall inwardly. The wall need only be pivoted inwardly for the compaction of scrap having crossmembers which it might be impossible to compress otherwise.

The parallelepipedal compaction chamber in accordance with this invention can therefore be reduced to approximately one-quarter of its volume. The top wall can be pivoted down so as to cut the volume approximately in half. For precompaction or breaking-down of the crossmembers inside a boiler or the like to be compacted, the pivotal wall section, which is only the lower half of one wall, is swung in to a position where at its closest it lies approximately on a plane vertically bisecting the chamber. Then this pivotal section is swung back out and the opposite wall is advanced halfway across the chamber so as fully to compact the scrap. The pusher can then press the fully compacted scrap out through the hole which takes up approximately one-quarter of an end wall of the chamber.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

SPECIFIC DESCRIPTION OF A PREFERRED EMBODIMENT

Figure 1:
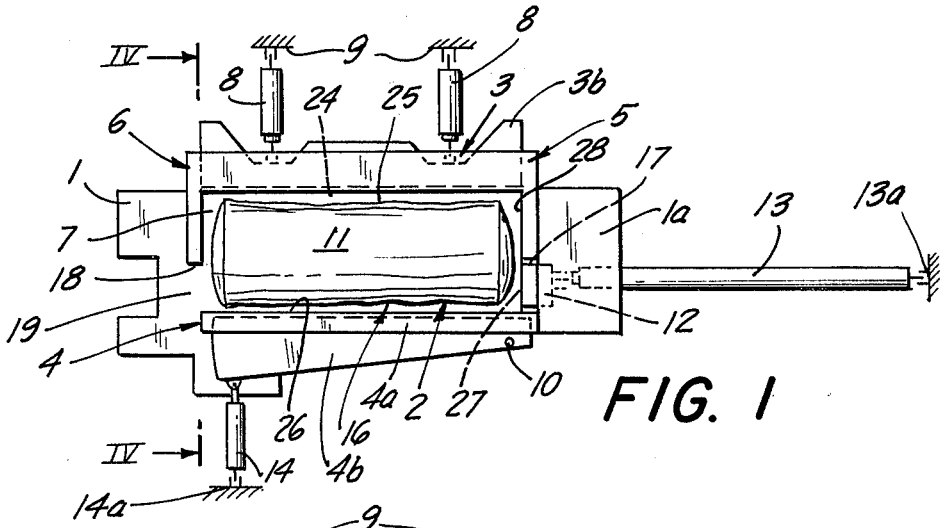
FIG. 1 is a top view of the press according to this invention before any compaction of a piece of scrap therein.

As shown in FIGS. 1–5, a compactor press according to this invention has a frame 1 on which a compaction chamber 2 is defined by elongated side walls 3 and 4, relatively short end walls 5 and 6, a floor 7, and a top wall 20. The chamber 2 is parallelepipedal and approximately three times as long as it is wide.

Figure 4:
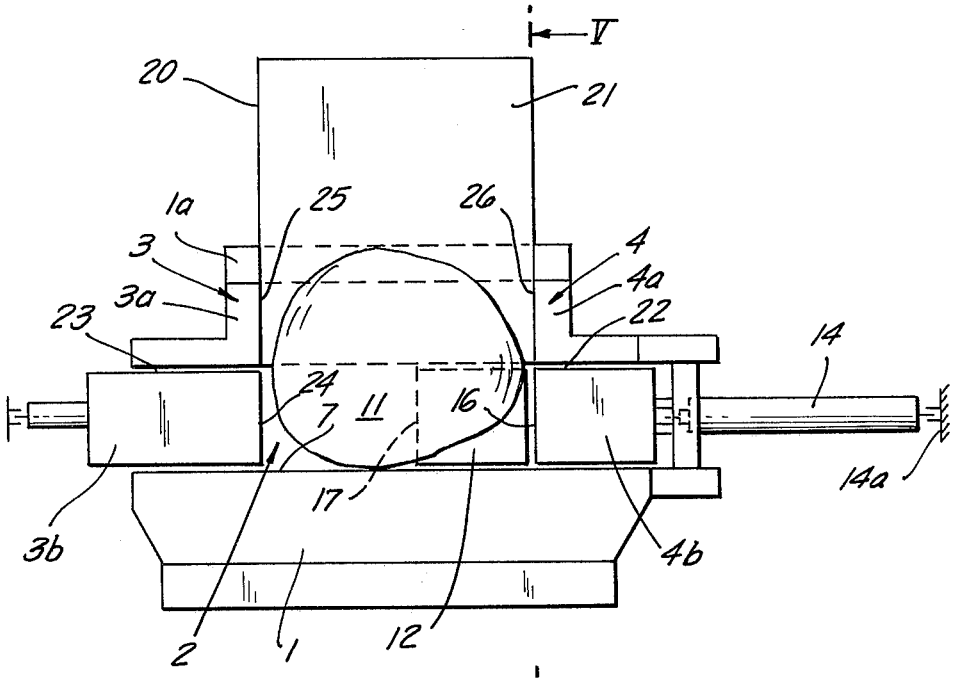
FIG. 4 is a section taken along line IV—IV of FIG. 1, shown in enlarged scale.

As best shown in FIG. 4, the side wall 3 is formed by a fixed upper wall portion 3*a* and a movable lower wall portion 3*b*. The portion 3*b* is approximately the same height as the portion 3*a* so that the horizontal plane 23 at the top of the wall portion 3*b* substantially horizontally bisects the chamber 2. In addition the wall 4 which is parallel to the wall 3*b* is similarly formed by a fixed upper portion 4*a* and a movable lower portion 4*b*. The upper surface 22 of the portion 4*b* is coplanar with the surface 23. The walls 3 and 4 are parallel to each other and are defined by inner surfaces 24 and 25 of the wall 3 and parallel planar surfaces 16 and 26 of the wall 4.

Figure 2:
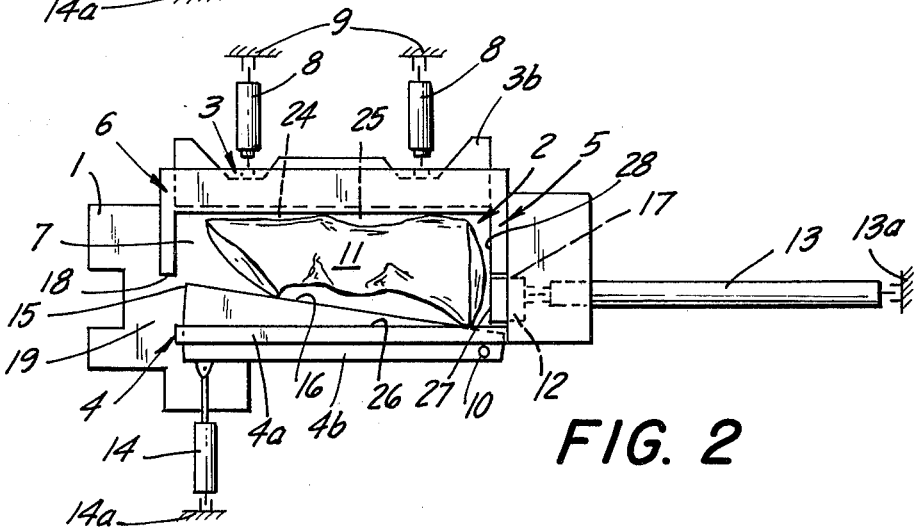
FIGS. 2 and 3 are views similar to FIG. 1 illustrating subsequent steps in the operation of the compactor of this invention.
Figure 3:
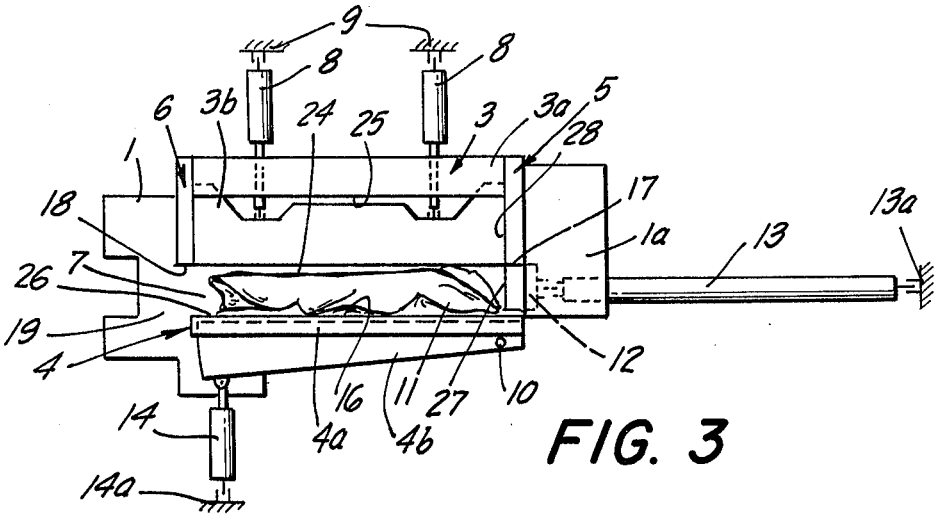

As best shown in FIGS. 1–3 the wall portion 4*b* is formed generally as a segment of a circle pivotal about an upright axis 10 adjacent the one end wall 5. A ram 14 supported at 14*a* on the frame 1 can displace this wall portion 4*b* so that its inner surface is moved at its downstream end to a plane 17 (FIG. 4) which lies between one-third and two-thirds of the way between the surfaces 25 and 26.

The wall portion 3*b* is not pivotal but is movable by a pair of rams 8 supported at 9 on the frame 1 into a position where it also can have its face 16 substantially at the plane 17.

The end wall 5 has an inner surface 28 and is formed with a hole in which is provided a pusher-ejector 12 that is displaceable all the way the full length of the chamber 2 by means of a ram 13 supported at 13*a* on the frame 1. This pusher 12 has a face 27 which can lie coplanar with the surface 28, but which can also be moved all the way to the opposite end of the chamber 2.

The opposite end wall 6 is fixed and has an edge 18 defining an outlet opening 19 through which the pusher 12 is engageable. The width of the pusher 12 and of the opening 19 is slightly less than one-half the width of the chamber perpendicular to the walls 3 and 4. The pusher 12 can run along one side on the face 16 of the element 4*b* to the extreme downstream end 15 thereof and at its other side runs along the plane 17.

Figure 5:
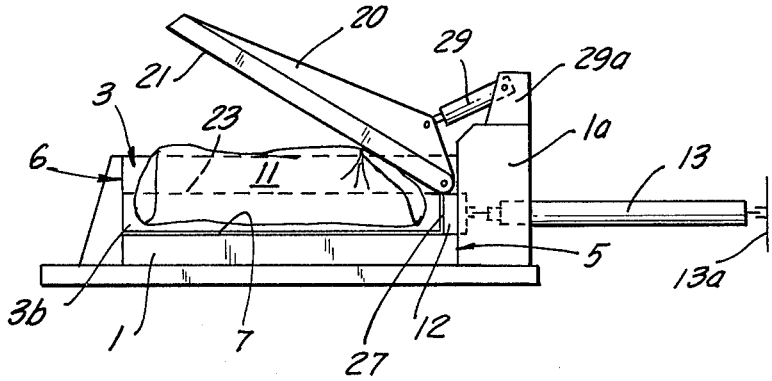
FIG. 5 is a section taken along line V—V through FIG. 4 illustrating the first step of the compaction process.

FIG. 5 shows how the frame has an upright 1*a* on which is pivoted about a horizontal axis lying substantially at the level of the surfaces 22 and 23 a top wall 20 having a lower surface 21 displaceable down into a position coplanar with the surfaces 22 and 23. A ram 29 pivoted at 29*a* on the upright 1*a* can effect this pivoting action.

The apparatus described above functions as follows:

A piece of scrap 11, here shown to be a steel boiler, is placed between the walls 3–6 after lifting-up of the top wall 20. This scrap 11 is loaded in in a position in which the wall sections 3*b* and 4*b* are retracted so that the surfaces 24 and 16 are coplanar with the surfaces 25 and 26 and when the face 27 of the pusher 12 is coplanar with the inner surface 28 of the wall 5.

Thereafter, as shown in FIG. 5, the cylinder 29 is pressurized so as to pivot the upper wall 20 downwardly until its lower surface 21 is coplanar with the upper surfaces 22 and 23 of the parts 3*b* and 4*b*.

Thereupon the wall section 4*b* is pivoted inwardly from the position of FIG. 1 to the position of FIG. 2 so that its downstream end 15 lies substantially on the plane 17 parallel or slightly beyond the edge 18 of the opening 19. This precompresses the boiler 11 and serves to break down any crossmembers therein. Such a pivoting action about the axis 10 is not directly perpendicular to the longitudinal axis of this boiler 11 so that a great deal less force is necessary to crush the boiler 11 transversely than would otherwise be necessary.

Thereafter as shown in FIG. 3 the wall 4*b* is returned to its original position and the cylinders 8 are pressurized to move the surface 24 toward the surface 16 while maintaining it parallel thereto. The surface 24 is moved all the way over to the plane 17 at the edge of the pusher 12 and the opening 19.

Finally the cylinder 13 is pressurized to push the fully compacted piece of scrap 11 out of the chamber 2 through the hole 19.

It is noted that the swinging-down of the top wall 20 can take place before or after the pivoting-in of the wall 4*b*.

With the system according to this invention it is therefore possible to compact scrap which normally would require an extremely heavy-duty apparatus. This greatly reduces the cost of the compactor press and at the same time makes it operate with a great deal of less wear, as the considerably reduced forces cause the various surfaces to rub against each other with a great deal less force and, therefore, wear less.

It will be understood that each of the elements described above, or two or more together, may also find a useful application in other types of structure differing from the types described above.

While the invention has been illustrated and described as embodied in a scrap compactor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A scrap compactor comprising:

a fixed base plate having a substantially planar and uninterrupted horizontal upper surface;

first and second spaced-apart upright side walls defining lateral sides of a scrap-compaction chamber and each having a fixed upper portion spaced above said surface and a lower portion between the respective upper portion and said surface and horizontally displaceable relative thereto;

third and fourth spaced-apart upright longitudinal end walls defining longitudinal ends of said chamber and extending transversely between said side walls;

a top wall displaceable between a raised position well above said first and second walls and a lowered position generally parallel to said surface and generally level with lower edges of said upper portions;

means for pivoting said lower portion of said first wall longitudinally and transversely relative to said surface between an outer position relatively far from and generally parallel to said second wall and an inner position relatively close to and inclined relative to said second wall; and means effective in said outer position of said lower portion of said first wall for displacing one of said lower portions horizontally along said surface toward the other lower portion while maintaining said portions generally parallel.

2. The compactor defined in claim 1, wherein said lower portion extends the full longitudinal length of said chamber between said end walls and is pivotal in its entirety on said base plate about a pivot axis adjacent one of said end walls and immediately outside said chamber.

3. The compactor defined in claim 1; further comprising a pusher at one of said end walls next to said first side wall and spaced from said second side wall, the other of said end walls being formed adjacent said first side wall with an outlet aligned with said pusher, and means for displacing said pusher longitudinally the full length of said chamber and thereby pushing a piece of fully compacted scrap from said chamber through said outlet.

4. The compactor defined in claim 3, wherein said top wall is pivotal relative to and at said one end wall.

5. The compactor defined in claim 1, wherein each of said side walls has a planar lower face formed by the respective lower portion and a planar upper face formed by the respective upper portion, the upper and lower faces of each of said side walls extending perpendicular to said surface of said bottom plate and being vertically alignable.

6. The compactor defined in claim 1, wherein said end walls, upper portions, and base plate are relatively fixed.

7. A method of compacting a piece of scrap in a generally parallepipedal compaction chamber defined between vertically spaced top and bottom walls, longitudinally and horizontally spaced end walls, and transversely and horizontally spaced side walls, said method comprising the steps of sequentially:

placing said piece of scrap in said chamber;

pivoting said top wall down in contact with said piece of scrap from a raised position inclined to said bottom wall to a lowered position generally parallel thereto, whereby said piece of scrap in said chamber is vertically precompressed;

pivoting a lower portion of one of said side walls relative to said bottom wall from an outer position relatively far from and generally parallel to the other of said side walls to an inner position relatively close to and inclined to said other side wall, whereby the vertically precompressed piece of scrap is also horizontally precompressed;

pivoting said lower portion back into said outer position;

sliding the lower portion of said other side wall toward said lower portion of said one side wall while maintaining said lower portions parallel, whereby said vertically and horizontally precompressed piece of scrap is fully compressed; and pushing the fully compressed piece of scrap longitudinally out of said chamber through an outlet in one of said end walls.

8. The method defined in claim 7, wherein said lower portion lies in said inner position at its closest between one-third and two-thirds of the horizontal transverse distance between said first and second walls.

* * * * *